US008771157B2

(12) United States Patent
Caponigro

(10) Patent No.: US 8,771,157 B2
(45) Date of Patent: Jul. 8, 2014

(54) FOOT PIVOT SPORTS TRAINING AID

(75) Inventor: James Caponigro, Aberdeen, NJ (US)

(73) Assignee: James Caponigro, Aberdeen, NJ (US)

( * ) Notice: Subject to any disclaimer, the term of this patent is extended or adjusted under 35 U.S.C. 154(b) by 146 days.

(21) Appl. No.: 13/116,761

(22) Filed: May 26, 2011

(65) Prior Publication Data

US 2011/0312479 A1 Dec. 22, 2011

Related U.S. Application Data

(60) Provisional application No. 61/356,928, filed on Jun. 21, 2010.

(51) Int. Cl.
*A63B 22/14* (2006.01)
*A63B 23/08* (2006.01)
*A63B 69/00* (2006.01)

(52) U.S. Cl.
USPC ..... 482/147; 482/79; 473/452

(58) Field of Classification Search
USPC ..... 482/79–80, 146–147, 51, 92, 131, 132, 482/141, 142, 148; 473/207, 217–219, 266, 473/269–270, 272, 422, 451–453; 601/27–28, 32
See application file for complete search history.

(56) References Cited

U.S. PATENT DOCUMENTS

| | | | | |
|---|---|---|---|---|
| 3,372,930 | A * | 3/1968 | Sertich | 473/452 |
| 3,575,412 | A * | 4/1971 | Arsenian et al. | 482/71 |
| 4,560,165 | A * | 12/1985 | Witteman et al. | 473/269 |
| 5,263,863 | A * | 11/1993 | Stefani et al. | 473/269 |
| 5,279,533 | A * | 1/1994 | Yin et al. | 482/147 |
| 5,318,290 | A * | 6/1994 | Sawyer | 473/217 |
| 5,368,535 | A * | 11/1994 | Twardokens | 482/79 |
| 5,692,323 | A * | 12/1997 | Goldberg | 36/134 |
| 5,766,119 | A * | 6/1998 | Clark | 482/146 |
| 5,980,433 | A * | 11/1999 | Ramsay | 482/80 |
| 6,638,176 | B1 * | 10/2003 | Hayes et al. | 473/266 |
| 8,025,588 | B2 * | 9/2011 | Olson | 473/269 |
| 8,221,271 | B1 * | 7/2012 | McIntyre | 473/452 |
| 2006/0089241 | A1 * | 4/2006 | Klein et al. | 482/141 |
| 2008/0188331 | A1 * | 8/2008 | Shimizu et al. | 473/451 |
| 2009/0181811 | A1 * | 7/2009 | Bard | 473/452 |
| 2012/0214621 | A1 * | 8/2012 | Miller et al. | 473/451 |

OTHER PUBLICATIONS http://www.highoutputsports.com/The_Accelerator.html.

* cited by examiner

*Primary Examiner* — Loan H Thanh
*Assistant Examiner* — Gregory Winter

(57) ABSTRACT

A foot pivot sports training aid is disclosed. The training aid may include a platform coupled to a base. The platform may rotate around the base. The platform may include an upwardly projecting baffle with an inwardly facing contour and/or a sloped surface.

4 Claims, 2 Drawing Sheets

FOOT PIVOT SPORTS TRAINING AID

CROSS-REFERENCE TO RELATED APPLICATION

This application claims the benefit of priority of U.S. provisional patent application Ser. No. 61/356,928, filed, Jun. 21, 2010, the contents of which are herein incorporated by reference.

BACKGROUND OF THE INVENTION

The present invention generally relates to sports training aids, and more particularly, to a foot pivot sports training aid.

In some sports, an athlete practices the repetitive movement of particular movements to improve form. The more one practices, the better muscle memory is created in performing the movement. However, repetitive practice of a movement incorrectly may cause one to perfect an inefficient form thus causing underperformance during execution of the movement.

For example, a baseball or softball player may spend countless hours swinging a bat. One portion of the swing worked on is the pivoting of the front portion of a back foot inward and down into the ground. Ideally, according to some, the back foot should pivot inwardly on an invisible vertical axis going through the top of one's foot through the ball of the foot. Imperfect form may include leaving the back foot flat, dragging the back foot forward with the swing, or shifting the back foot laterally to the sides or backward during slippage.

Some teaching methods include using analogies such as reminding batters to "squish the bug" as if a bug were under the back foot or to imagine a nail driven through the foot and to turn on the nail. However, verbal aids require the batter to be mindful of the placement and movement of their back foot rather than allowing the batter to focus on swinging at a ball.

As can be seen, there is a need for an apparatus that allows a user to practice pivoting a back foot without needing to focus on doing so.

SUMMARY OF THE INVENTION

In one aspect of the present invention, a foot pivot sports training aid comprises a base; a platform coupled to the base, the platform configured to rotate over the base; and a first wall projecting upward from the platform, the wall including a first inwardly facing contour configured to receive an instep of a user foot.

In another aspect of the present invention, a foot pivot training aid comprises a base including a circular area; a footrest positioned over the base, the footrest disposed to rotate over the base; and a slope disposed in the footrest configured to allow a ball of a user's foot to pivot inward while raising a heel of the user's foot during rotation of the footrest.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims. Various inventive features are described below that can each be used independently of one another or in combination with other features.

Broadly, embodiments of the present invention generally provide a foot pivot sports training aid that maintains a user's proper form in pivoting a back foot. Aspects of the training aid provide a pivoting platform with guides that maintain a back foot on an invisible vertical axis during a swinging and pivoting motion.

Figure 1:
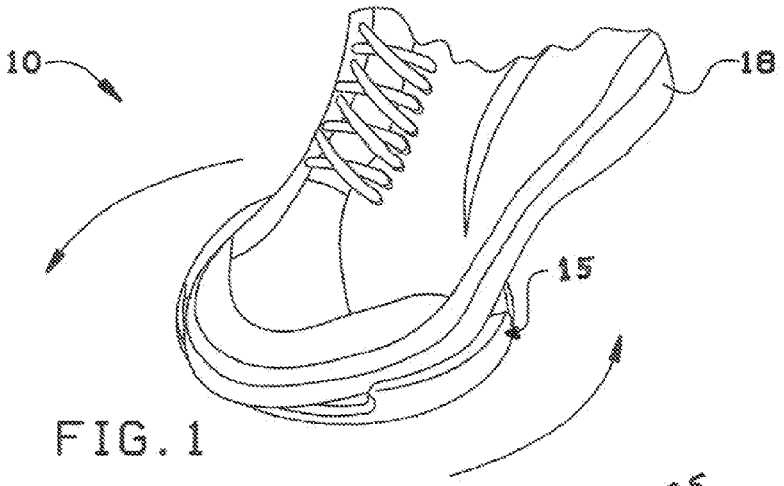
FIG. 1 is a perspective view of a foot pivot sports training aid in use according to an exemplary embodiment of the present invention.
Figure 2:
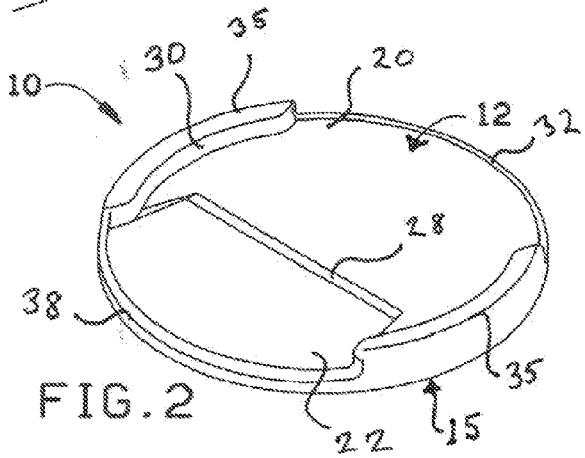
FIG. 2 is a perspective view of the foot pivot sports training aid of FIG. 1.
Figure 3:
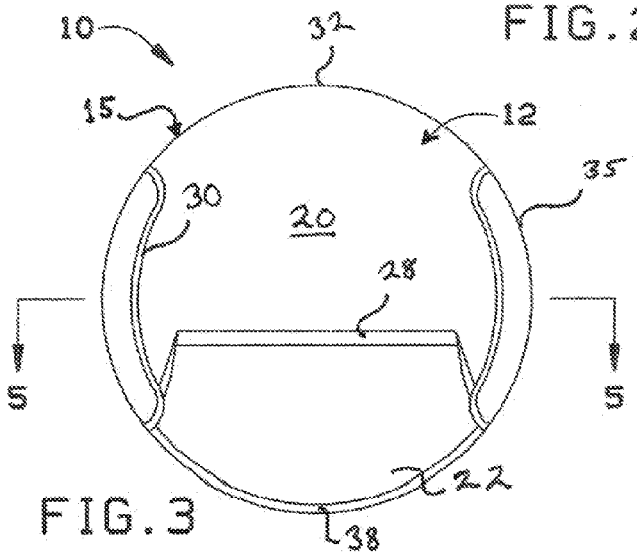
FIG. 3 is a top view of the foot pivot sports training aid of FIG. 1.
Figure 4:
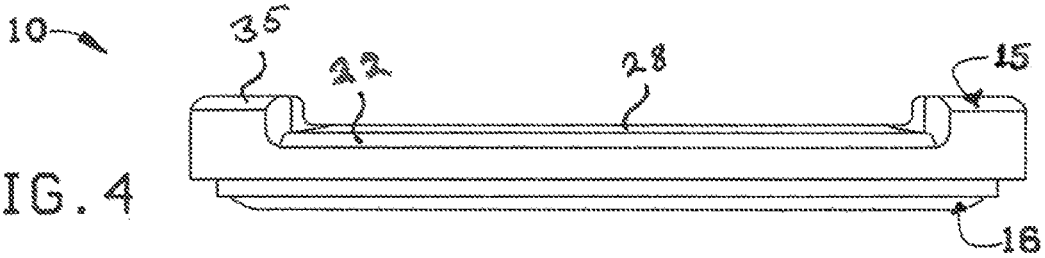
FIG. 4 is a front view of the foot pivot sports training aid of FIG. 1.

Referring now to the Figures, FIG. 1 shows a foot pivot training aid 10 employed during use while a user's back foot 18 is engaged on a platform 15. For sake of illustration, FIG. 1 illustrates use of the training aid 10 with a right handed user employing their right foot as the back foot. It will be understood however, that the training aid 10, in some exemplary embodiments, may be configured for use exclusively by either foot or configured to allow users, such as switch hitters, to use with either foot interchangeably.

Referring to FIGS. 1-4, the foot pivot sports training aid 10 generally includes a base 16 and a platform 15. The base 16 and the platform 15 may be separable elements with the platform 15 coupled and fitted for receipt over the base 16. The foot pivot sports training aid 10 may be configured to allow the platform 15 to rotate or pivot freely over the base 16.

In one exemplary embodiment, the foot pivot sports training aid 10 may include one or more baffles 35, for example, side walls projecting upward from the platform. A baffle 35 may include an inwardly facing contour 30 configured to receive the outer portion of the ball of one's foot and inset. Exemplary embodiments may include positioning a pair of baffles 35 on opposite sides of the platform 12 to face one another. The baffles 35 may be spaced and disposed to allow placement of a user's foot therebetween.

Exemplary embodiments of the foot pivot sports training aid 10 may also include a footrest 12 integrated into the platform 15. The footrest 12 may include a sloped surface 22. The sloped surface 22 may be disposed intermediate a front side 38 and a back side 32 of the platform 15; the front and back sides being defined relative to a user's back foot 18. The footrest 12 may also include a flat area 20 disposed behind or above the sloped surface 22 that may extend to the back side 32. The sloped surface 22 may taper downward from the flat area 20 to the front side 38. The footrest 12 may further include a sloped retaining wall 28 disposed between a top edge of the slope and the flat area 20.

Figure 5:
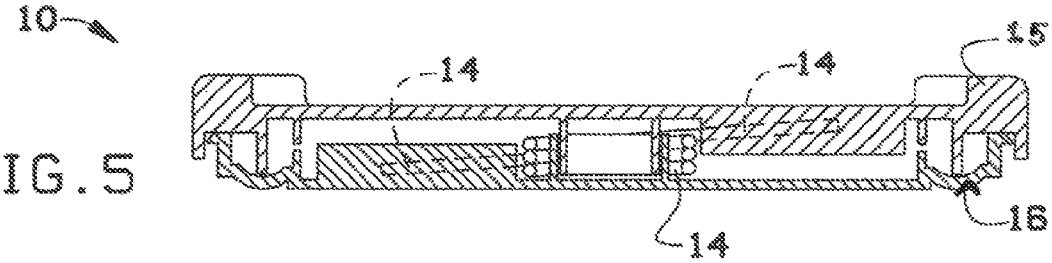
FIG. 5 is a cross-sectional view of the foot pivot sports training aid of FIG. 4 taken along the line 5-5.
Figure 6:
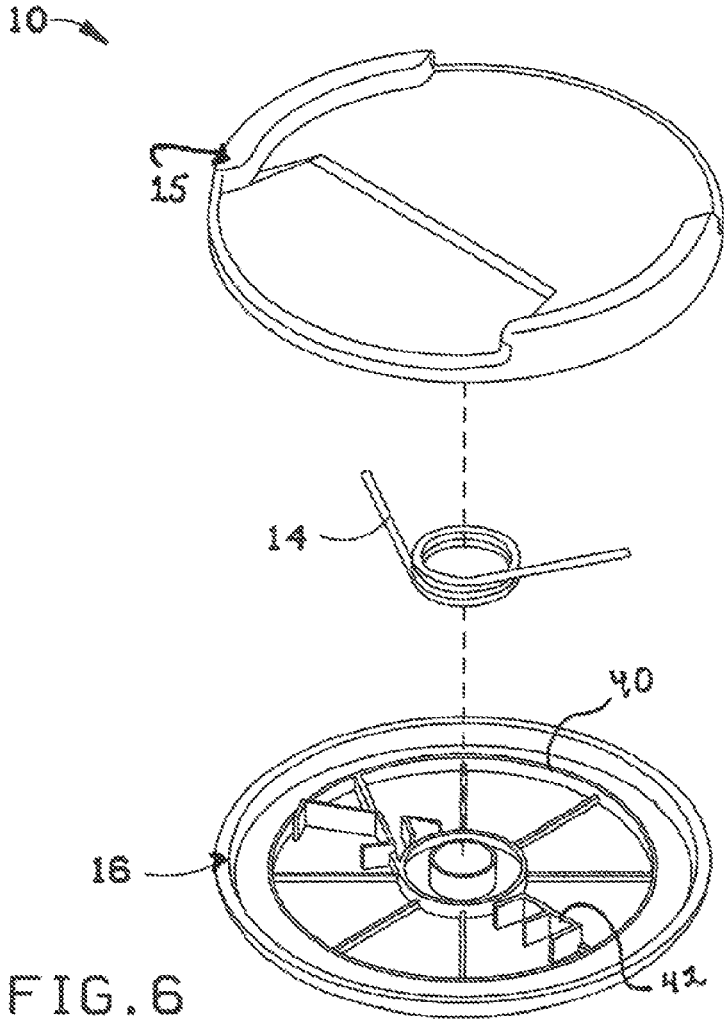
FIG. 6 is an exploded view of the foot pivot sports training aid of FIG. 1.

Referring to FIGS. 5 and 6, the sports pivot training aid 10 may also include a spring loaded return, for example, a tension spring 14 coupled between the platform 15 and the base 16. In one exemplary embodiment, the platform 15 may be circular and the base 16 may include at least a circular area 40 underneath the platform 15 for support during rotation of the platform 15. The tension spring 14 may be tension fit on one end into a catch (not shown) disposed on an underside of the platform 15 and by the other end into a catch 42 disposed within the base 16.

In an exemplary operation of the sports pivot training aid 10, a user may position their back foot onto the platform 15 and into the footrest 12 with the inside of the foot abutting the contour of a baffle 35. As the user swings, the user may apply pressure with the inside of the foot against the baffle 35 and the ball of the foot onto the sloped surface 22. As pressure is applied, the platform 15 rotates over the base 16. Lateral movement of the instep and ball of the foot may be resisted by encountering the baffle 35. The ball of the foot and toes may be encouraged to point groundward while a medial portion of the foot may press against the retaining wall 28 providing a counterforce against backward movement. Additionally, as the foot pivots on the sloped surface 22 and pushes against the retaining wall 28, the heel of the foot may be forced to lift upward further driving the instep and ball of the foot to pivot inward yet, maintain their lateral position along an invisible vertical axis going through the ball of the foot. Thus, the hips of a user may fully explode through the swing and proper form may be achieved. As the swing is terminated, the negative muscle movement may also be exercised with assistance from the tension spring 14 providing a counterforce to return the foot back to a default position.

It should be understood, of course, that the foregoing relates to exemplary embodiments of the invention and that modifications may be made without departing from the spirit and scope of the invention as set forth in the following claims.

What is claimed is:

1. A foot pivot training aid, comprising:

a base including a circular area;

a footrest positioned on a platform over the base, the footrest disposed to rotate over the base;

a sloped surface disposed in the footrest, the footrest configured to allow a ball of a user's foot to pivot inward while raising a heel of the user's foot during rotation of the footrest, the sloped surface commencing from a line extending across the footrest intermediate to a front side and a back side of the platform, wherein:

the front side of the platform is configured for engagement with the user's toes, and the sloped surface tapers downwardly from the line extending across the footrest to the front side of the platform; and a retaining wall disposed between a top edge of the sloped surface and a flat portion of the footrest, wherein the flat portion is disposed above the sloped surface.

2. The foot pivot training aid of claim 1, further comprising a pair of baffles positioned opposite one another on the platform, wherein the front side of the platform is disposed between an opening between ends of the pair of baffles.

3. The foot pivot training aid of claim 2, wherein the pair of baffles includes opposing inwardly facing curved contours.

4. The foot pivot training aid of claim 1, further comprising a spring loaded return coupling the platform to the base.

* * * * *